US005758742A

United States Patent [19]

Chiou et al.

[11] Patent Number: 5,758,742

[45] Date of Patent: Jun. 2, 1998

[54] SAFETY ANCHOR

[76] Inventors: Hsiu-Hsing Chiou, No. 13, Lane 5, Lung Cheng Yi St., Pingzen Taoyuan; Cheng-Hsiung Yuan, 2F, No. 18-6 JingHua St., Taipei; Ming-Shien Yuan, No. 1, Lane 5, Lung Cheng Yi St., Pingzen, Taoyuan, all of Taiwan

[21] Appl. No.: 758,304

[22] Filed: Dec. 3, 1996

[51] Int. Cl.[6] ..... A47L 3/04

[52] U.S. Cl. ..... 182/3; 248/221.11; 248/221.12; 248/224.7

[58] Field of Search ..... 182/3, 45; 248/221.11, 248/221.12, 222.52, 224.7; 411/347, 549

[56] References Cited

U.S. PATENT DOCUMENTS

| | | | |
|---|---|---|---|
| 1,329,131 | 1/1920 | Mepsted | 411/347 |
| 2,608,843 | 9/1952 | Kennedy | 248/222.52 X |
| 3,179,994 | 4/1965 | Meyer et al. | 182/3 X |
| 3,576,437 | 4/1971 | Peron | 248/222.52 X |
| 3,588,020 | 6/1971 | Newcomer | 248/222.52 |
| 4,140,205 | 2/1979 | Matson | 182/3 |
| 4,606,430 | 8/1986 | Roby et al. | 182/3 |
| 5,004,071 | 4/1991 | Mallard et al. | 182/3 |
| 5,143,171 | 9/1992 | Glynn et al. | 182/3 |
| 5,209,018 | 5/1993 | Heinrich | 411/347 X |
| 5,215,332 | 6/1993 | DeSloovere | 248/221.12 X |
| 5,372,346 | 12/1994 | Upchurch et al. | 248/222.52 X |

FOREIGN PATENT DOCUMENTS

| | | | |
|---|---|---|---|
| 62421 | 10/1982 | European Pat. Off. | 411/347 |
| 1571467 | 6/1969 | France | 411/347 |
| 10127 | of 1913 | United Kingdom | 411/347 |
| 564332 | 9/1944 | United Kingdom | 411/347 |
| 82/03015 | 9/1982 | WIPO | 182/3 |

*Primary Examiner*—Blair Johnson
*Assistant Examiner*—Richard M. Smith
*Attorney, Agent, or Firm*—Morton J. Rosenberg; David I. Klein; Jun Y. Lee

[57] ABSTRACT

A safety anchor includes a fixed member to be securely fixed on a building frame in construction or to a side wall of a building and a removable member releasably engageable with the fixed member for supporting or protecting a person from falling out of the building or building frame. The fixed member has an expanded base to be welded to the steel structure or the steel bar of a reinforced concrete structure or buried in the concrete structure and a central bore to receive the insertion of the removable member. The removable member has a sideways projected key to be guided by a first slot formed on inside surface of the bore during the insertion of the removable member. The bore also has a circumferential slot formed on the inside surface-thereof and in connection with the first slot and a retaining slot that is also connected to the circumferential slot but spaced from the first slot so that it is capable to retain the removable member within the bore of the fixed member by moving the key through the circumferential slot to get into and trap in the retaining slot. A spring is provided within the bore to prevent accident release of the key out of the retaining slot. A cable is attached to the removable member for securing the a person or an article thereon.

1 Claim, 11 Drawing Sheets

SAFETY ANCHOR

FIELD OF THE INVENTION

The present invention relates to a safety device and in particular to a safety anchor to be mounted to a side wall of a high building that has already been constructed or is in construction to allow a person or other safety device, such as safety net, to be secured thereto for the prevention of accidental fall of the person or other article from the high building.

BACKGROUND OF THE INVENTION

The development of large cities brings about high buildings and even skyscrapers. Such high buildings causes a safety problem of falling from the buildings. A person falls from the high buildings would inevitably severely damaged and even die eventually. Small articles, such as a bolt, falls from a high building in construction would also causes serious damage to a person passing thereunder. All theses situations regarding safety cause the development of high building safety devices.

For buildings in construction, safety nets or guard nets are used to prevent the fall of personnel or other articles. The safety nets, although useful in preventing the fall of articles and personnel, yet is not an effective and efficient manner for it takes times to install and to dismount from the building once the building is completed. Further, it is quite possible that a falling article or personnel is falling at a location not covered by the safety net. It is thus desirable to have a high building safety device that is more effective and more efficient in protecting human lives.

Further, in a high building, there is always a need of emergency escaping device that allows a person to get out of the high building from the height thereof. There are already emergency escaping devices available in the market. Those emergency escaping devices usually need anchorage to the wall for support in order to support the escaping person.

It is therefore desired to have a more effective and efficient high building safety device that is left on the side walls of a high building after the construction of the building is completed to serve as the anchorage for emergency escaping devices.

OBJECTS OF THE INVENTION

Therefore, the principal object of the present invention is to provide a high building safety device which comprises a fixed member securely fixed on the side wall of a high building and a removable member which is removably engageable with the fixed member for hanging a person, either a construction worker or a resident of the high building, to prevent accident fall of the person.

Another object of the present invention is to provide a safety anchor which comprises a fixed member securely fixed on the side wall of a high building and a removable member releasably engageable with the fixed member so as to provide a handy, easily-removable anchorage for other safety devices, such as safety net so as to allow the other safety devices to be installed in a more time-efficient manner through the releasable engagement between the fixed member and the removable member.

A further object of the present invention is to provide a safety anchor which comprises a fixed member securely fixed on the side wall of a high building and a removable member releasably engageable with the fixed member so as to provide a handy, easily-removable anchorage for a high building emergency escaping device through the engagement between the fixed member and the removable member, such a fixed member being small and compact so as to be fixed on the building walls without significantly effecting the outside appearance of the building.

To achieve the above objects, there is provided a safety anchor comprising a fixed member to be securely fixed on a building frame in construction or to a side wall of a building and a removable member releasably engageable with the fixed member for supporting or protecting a person from falling out of the building or building frame. The fixed member has an expanded base to be welded to the steel structure or the steel bar of a reinforced concrete structure or buried in the concrete structure and a central bore to receive the insertion of the removable member. The removable member has a sideways projected key to be guided by a first slot formed on inside surface of the bore during the insertion of the removable member. The bore also has a circumferential slot formed on the inside surface thereof and in connection with the first slot and a retaining slot that is also connected to the circumferential slot but spaced from the first slot so that it is capable to retain the removable member within the bore of the fixed member by moving the key through the circumferential slot to get into and trap in the retaining slot. A spring is provided within the bore to prevent accident release of the key out of the retaining slot. A cable is attached to the removable member for securing the a person or an article thereon.

The present invention will be better understood from the following description of preferred embodiments in accordance with the present invention, with reference to the attached drawings, wherein:

DETAILED DESCRIPTION OF THE PREFERRED EMBODIMENTS

Figure 1:
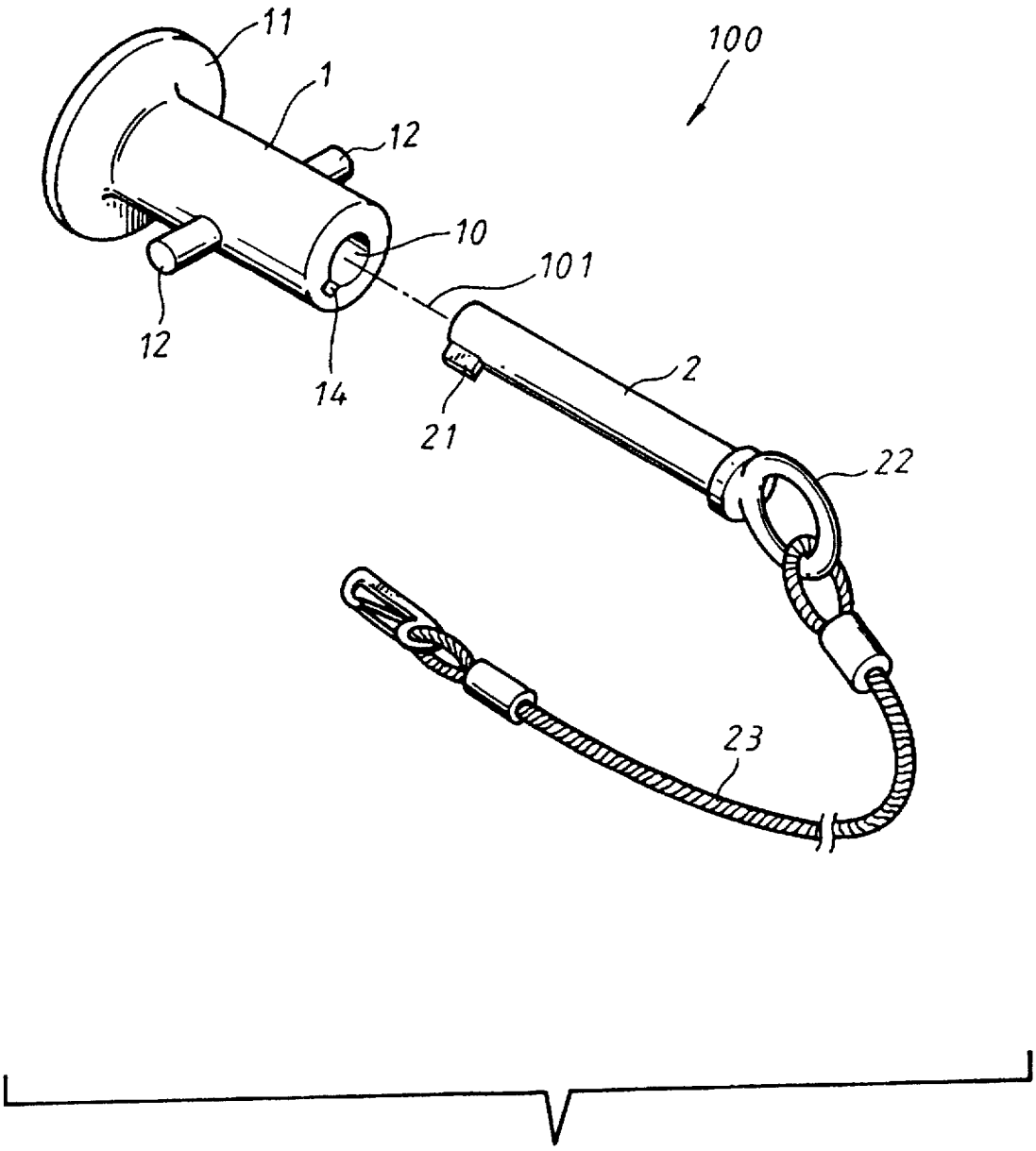
FIG. 1 is perspective view showing a safety anchor made in accordance with the present invention in a detached condition.

With reference to the drawings and in particular to FIG. 1, wherein a high building safety device, that is referred to as safety anchor herein, constructed in accordance with a first embodiment of the present invention, generally designated with reference numeral 100, is shown, the safety anchor 100 comprises a fixed member 1 and a removable member 2 releasably engageable with the fixed member 1. The fixed member 1 is preferably in the form of a cylinder having a pre-determined length along a central axis 101 with a base 11, which is preferably expanded in radial direction, fixed to an axial end thereof for fixing to a frame of a construction, such as a steel structure frame 4 shown in FIG. 10 or a reinforced concrete frame 5 shown in FIGS. 11 and 12. The fixed member 1 also has a circular, central bore 10 defining an opening on a free axial end of the fixed member 1 that is opposite to the base 11, and extending along the central axis 101. The central bore 10 of the fixed member 1 is dimensioned to loosely receive therein the removable member 2 so that the removable member 2 is removably and releasably receivable within the central bore 10 of the fixed member 1.

The removable member 2 is an elongated cylindrical plunger having a length corresponding to the length of the fixed member 1. The removable member 2 has provided on a remote end thereof body securing means for securing the body of a person or other article to be held on the side wall by the safety anchor 100. Preferably, the body securing means comprises a ring 22 fixed to the remote end of the removable member 2 to allow a wire or cable 23 attached thereto or tightened thereon for supporting for example a person 102, see FIG. 10.

Figure 2:
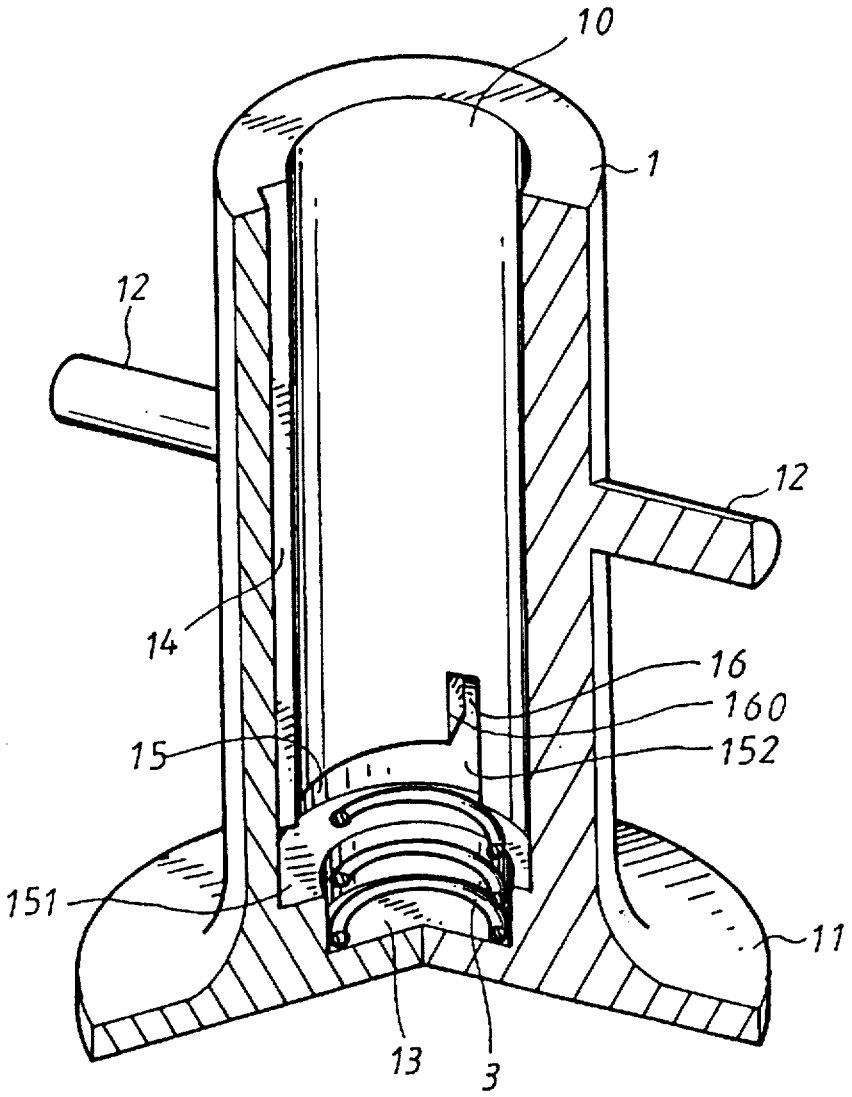
FIG. 2 is a perspective view showing the cylinder of the safety anchor in accordance with the present invention with the cylinder being broken to show inside structure thereof.

Also referring to FIG. 2, wherein a portion of the fixed member 1 is removed to show the inside structure thereof, the fixed member 1 has an axial slot 14 formed on an inside surface of the central bore 10 and extending from the opening of central bore 10 to bottom of the bore 10. The central bore 10 also has a circumferential slot 15 formed on the inside surface thereof and extending from an leading end 151 which forms a connection with the axial slot 14 to a tailing end 152 which connects to a retaining slot 16. The retaining slot 16 is provided on the inside surface of the central bore 10 so that the retaining slot 16 extends in a direction that defines an angle with the circumferential slot 15. Preferably, the retaining slot 16 extends axially and thus defines a right angle with the circumferential slot 15. The retaining slot 16 is substantially shorter than the axial slot 14 and defines no opening on the free end of the fixed member 1.

Biasing means, such as a helical spring 3, is disposed on the bottom of the central bore 10. Preferably, a recess 13 is provided on the bottom of the bore 10 into which the helical spring 3 is disposed and held in position with a portion thereof projecting out of the recess 13.

The removable member 2 is provided with a sideways projection or key 21 corresponding to and receivable within the axial slot 14 of the bore 10 when the removable member 2 is received within the central bore 10 of the fixed member 1.

Figure 3:
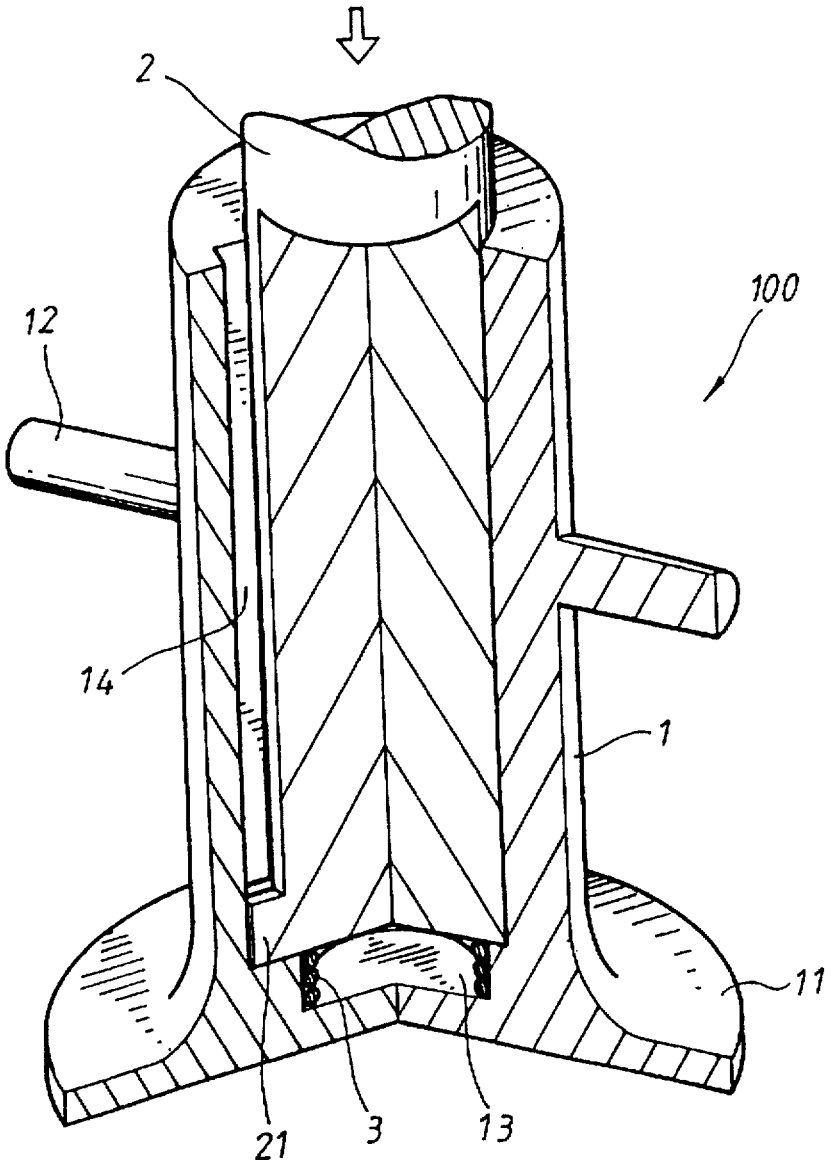
FIG. 3 is a perspective view of the safety anchor which is broken to show the initial phase of the engagement of the removable member with the cylinder.
Figure 4:
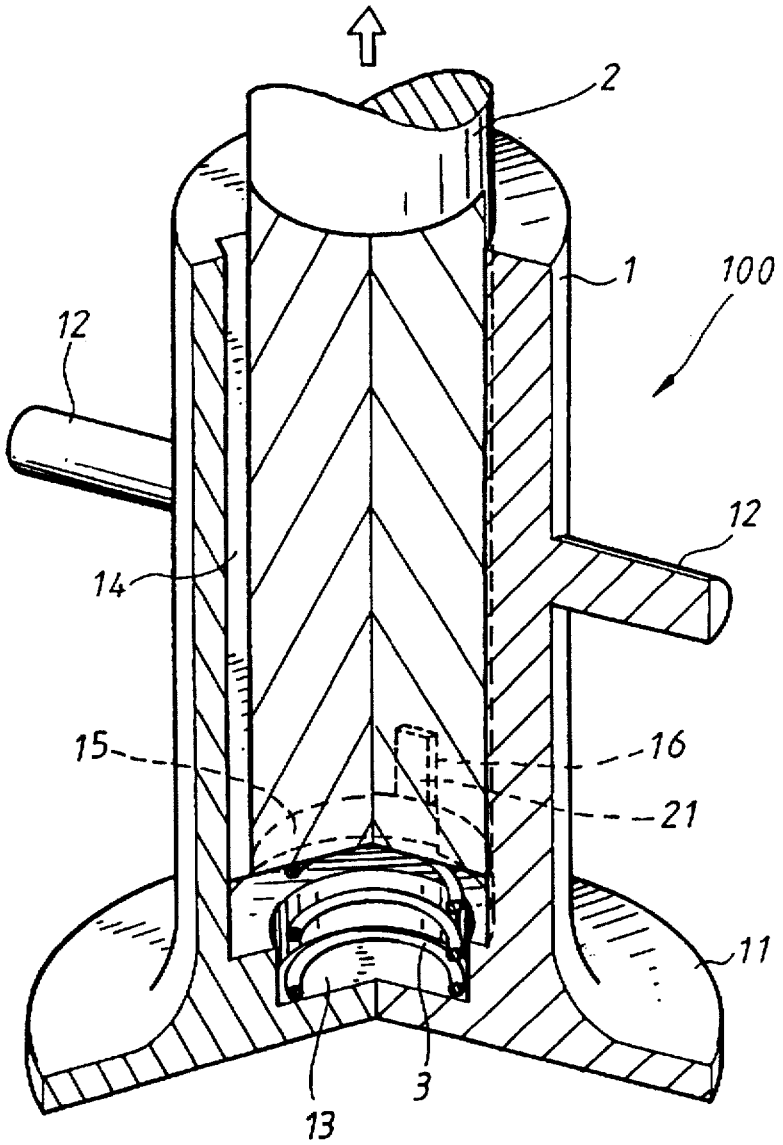
FIG. 4 is a view similar to FIG. 3, but showing the final phase of the engagement of the removable member with the cylinder.
Figure 5:
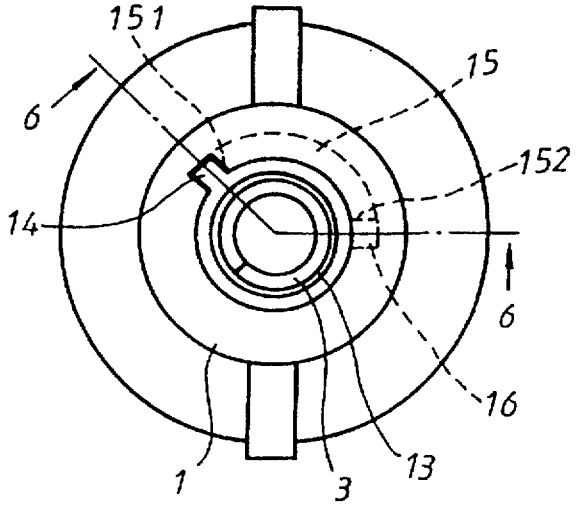
FIG. 5 is an end view showing the initial phase of the engagement of the removable member with the cylinder.
Figure 6:
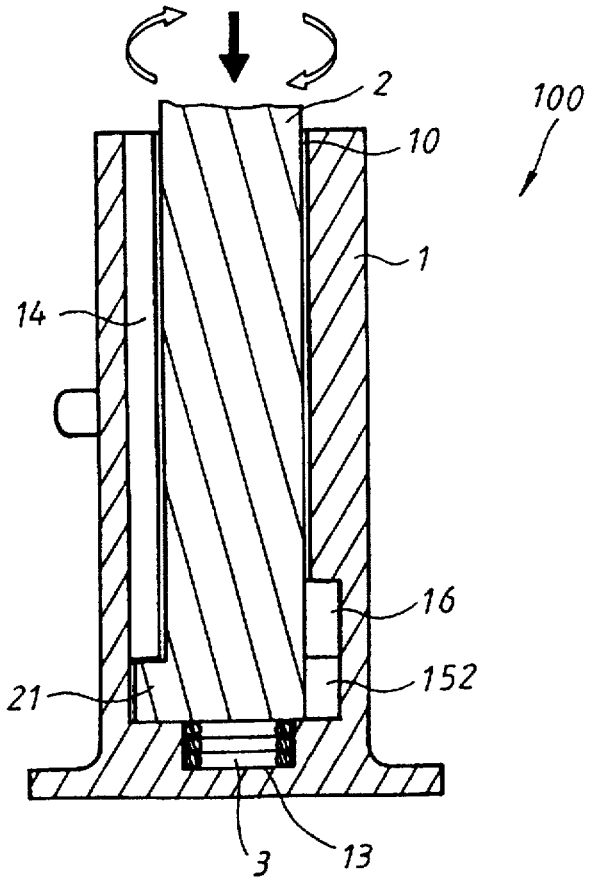
FIG. 6 is a cross-sectional view taken along line 6—6 of FIG. 5, showing the initial phase of engagement between the removable member and the cylinder.
Figure 7:
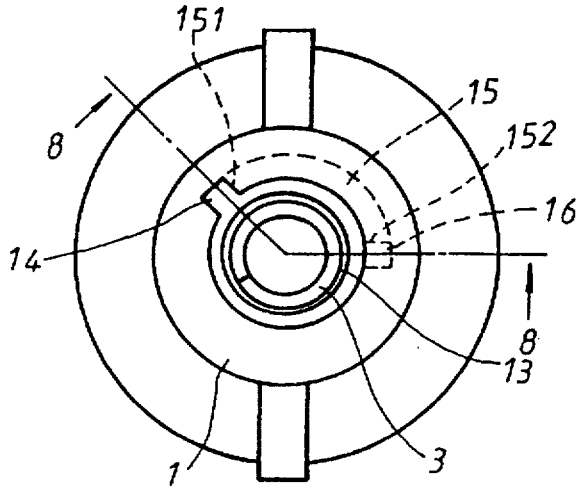
FIG. 7 is an end view showing the final phase of the engagement of the removable member with the cylinder.
Figure 8:
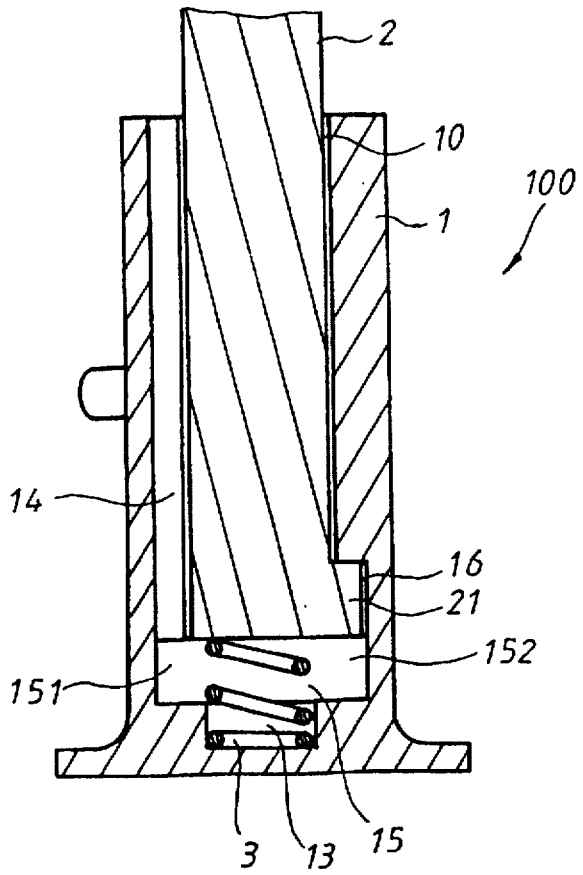
FIG. 8 is a cross-sectional view taken along line 8—8 of FIG. 7, showing the final phase of engagement between the removable member and the cylinder.

In operation, the removable member 2 is inserted into the bore 10 with the key 21 received in the axial slot 14. The removable member 2 is then moved toward the bottom of the central bore 10 to get contact with the spring 3. The removable member 2 is then further moved, against the spring 3, until the key 21 of the removable member 2 reaches the leading end 151 of the circumferential slot 15, see FIGS. 3, 5 and 6. Once the key 21 of the removable member 2 reaches the leading end 151 of the circumferential slot 15, the removable member 2 is rotated to have the key 21 move into and along the circumferential slot 15 to reach the tailing end 152. The removable member 2 is then released and the spring 3 biases the removable member 2 away from the bottom of the central bore to have the key 21 securely engaged by and trapped within the retaining slot 16, see FIGS. 4, 7 and 8. This secures the removable member 2 in the fixed member 1 and thus any person or any article that is fixed to the removable member 2 via the cable 23 is secured. In this respect, the key 21 has an axial dimension slightly smaller than width of the circumferential slot 15 as measured in the axial direction 101 to allow the key 21 to readily slide along the circumferential slot 15. The axial dimension of the retaining slot 16, however, should be greater than the width of the circumferential slot 15 so as to define a stop 160 that prevents the key 2 from getting out of the retaining slot 16 for effectively trapping the key 21 of the removable member 2 within the retaining slot 16 and thus securely retaining the removable member 2 in the central bore 10 of the fixed member 1.

The movement of the key 21 into the retaining slot 16 by means of the biasing force of the spring 3 also causes a sound generated by the contact between the key 21 with a side wall of the retaining slot 16. This provides an audio signal of the complete engagement of the key 21 with the retaining slot 16.

In accordance with the present invention, preferably, an angle defined between the axial slot 14 and the retaining slot 16 as measured around the central axis 101 is approximately 135 degrees.

In releasing the safety anchor 100, the removable member 2 is first forced toward the bottom of the bore 10, against the spring 3, to have the key 21 of the removable member 2 reach the tailing end 152 of the circumferential slot 15 and then rotate the removable member 2, to have the key 21 move into and slide along the circumferential slot 15 to reach the leading end 151. The removable member 2 is then allowed to disengage from the fixed member 1 by axially pulling the removable member 2 outward away from the bottom of the central bore 10.

Figure 10:
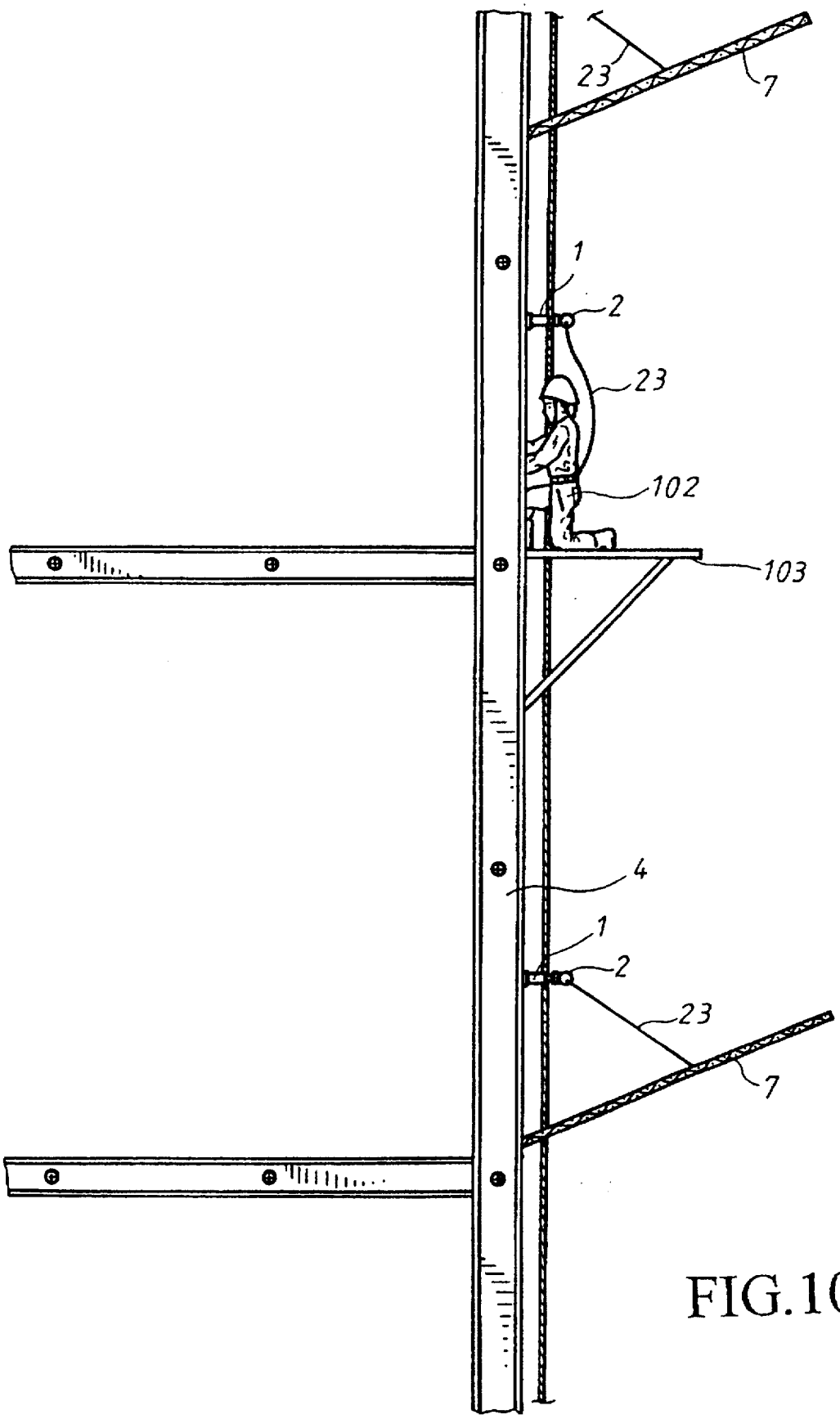
FIG. 10 is a schematic side elevational view showing the application of the safety anchor in accordance with the present invention in a steel structure building that is being constructed.

In practice, the fixed member 1 may be fixed to a steel structure frame 4, see FIG. 10, by simply welding the base 11 to the steel structure 4. A number of such fixed members 1 are distributed along the height of the steel structure frame 4 and at any desired positions on the steel structure frame 4. A construction worker 102 may then use a single removable member 2 with the cable 23 fixed to his or her body to attach himself or herself to any desired position on the steel structure frame 4 to prevent accidently fall out of a support platform 103. Preferably, the cable 32 has quite a length to allow free movement of the worker 102 within quite a space to perform his or her duty.

Still referring to FIG. 10, the fixed members 1 that are fixed to the steel structure frame 4 can also be used to hang and support other construction devices, such as safety net or guard net 7. The releasable engagement between the removable member 2 and the fixed member 1 allows the safety net 7 to be installed or dismounted in a more efficient manner.

Figure 11:
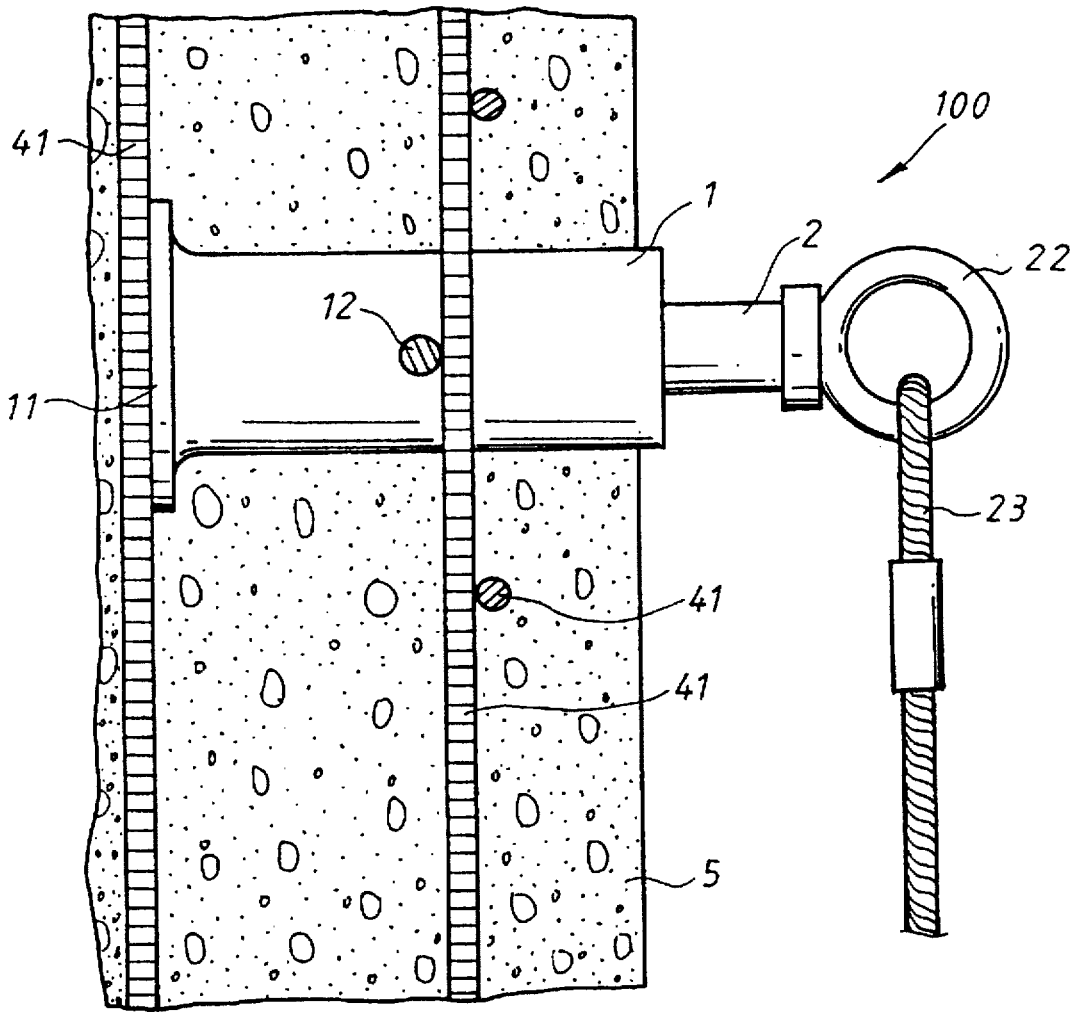
FIG. 11 is a cross-sectional view of a portion of a reinforced concrete building with a safety buckle in accordance with the present invention buried within the concrete and supported by the steel bars.
Figure 12:
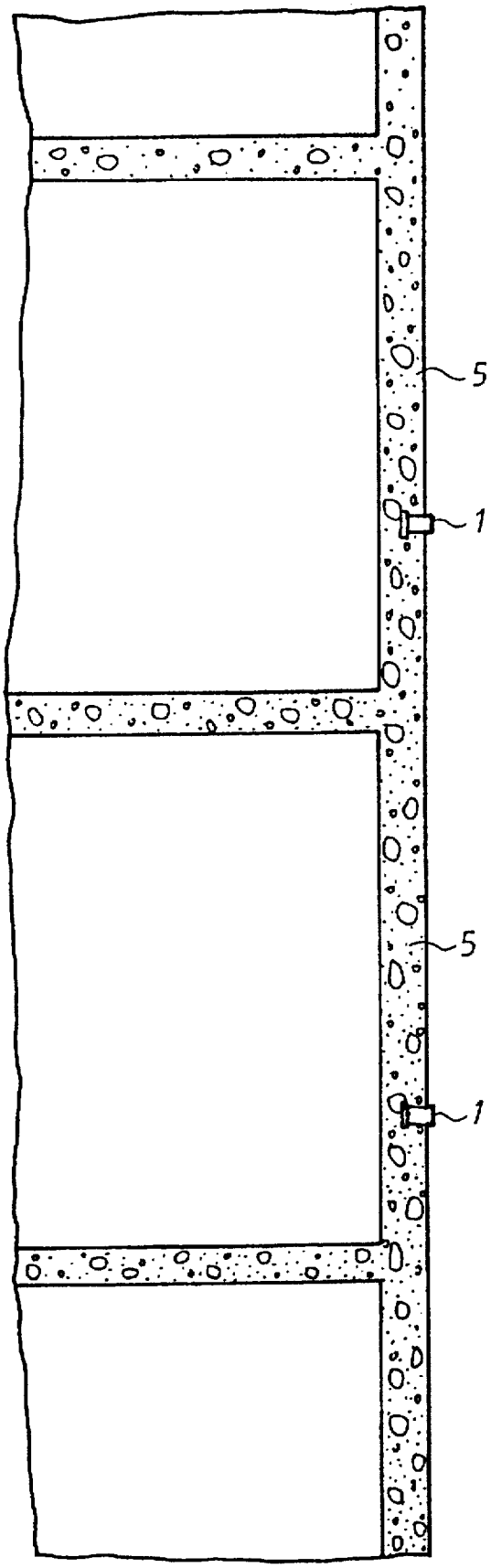
FIG. 12 is a schematic side elevational view showing the application of the safety anchor in accordance with the present invention in a reinforced concrete building in the way shown in FIG. 11.

In FIGS. 11 and 12, it is shown how to use the safety anchor 100 in a reinforced concrete frame 5. The fixed member 1 is buried in the concrete with the base 11 fixed to the steel bars 41, for example by welding. The fixed member 1 may also be provided with two side wings 12 which may assume the form of sideways extending rods, preferably located at a distance from the base 11 of approximately ⅗ of the length of the fixed member 1. The wings 12 may be intersected by the steel bars 41 of the reinforced concrete structure 5 so as to more firmly anchor the fixed member 1 within the concrete.

As shown in FIG. 12, similar to the case of the steel structure frame 4 in FIG. 10, a number of fixed members 1 are distributed on the reinforced concrete frame 5 for securing a person at any desired position.

Preferably, the fixed member 1 is fixed to the frame 4 (or 5) in such a way that the ring 22 of the removable member 2 is on a vertical plane, as shown in FIG. 11, when the removable member 2 is inserted into the fixed member 1. Further, the axial slot 14 of the fixed member 1 is preferably located in such an angle that when the removable member 2 is inserted into the bore 10 and the key 21 is retained within the retaining slot 16, the tab 21 and the retaining slot 16 are located at the vertically upper side. This is because when a weight is hung on the fixed member 1 through the removable member 2, the gravitational force applied to the removable member 2 tends to move the key 2 in a direction away from the bottom of the bore 10 which makes the key 21 more securely trapped within the retaining slot 16. If, on the contrary, the retaining slot 16 is in the lower side, then the gravitational force of the weight hung on the fixed member 1 tends to move the tab 21 toward the bottom of the bore 10 so that the tab 21 may be accidently released from the retaining slot 16.

Figure 13:
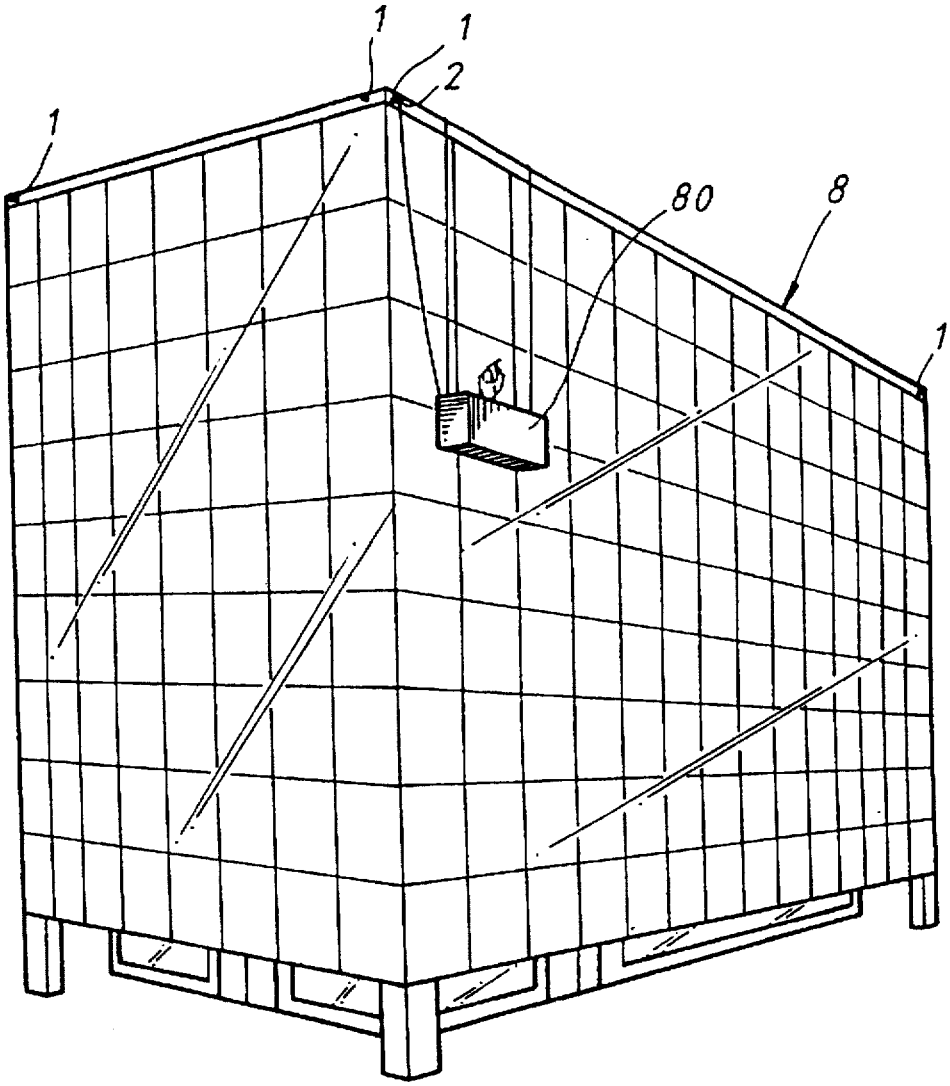
FIG. 13 is a schematic side elevational view showing the application of the safety anchor in accordance with the present invention in a high building as an emergency escaping device.

In FIG. 13, a further application of the safety anchor 100 of the present invention is illustrated, wherein a number of fixed members 1 are mounted on a high building 8 to allow an emergency escaping device 80 to be hung thereon easily and quickly by means of the releasably engagement between the fixed member 1 and the removable member 2 so that the present invention also provides an high building emergency escaping device. The small size of the fixed member 1 allows the fixed member 1 to be attached to the building 8 without significantly effecting the outside appearance of the building 8. Further, the fixed member 1 may be mounted to the frame of the building 8 during its construction. This allows the fixed member 1 that is used in a building in construction for the safety of construction workers to provide a further function of emergency escaping for the residents of the building. Further, the fixed member 1 does not need to be removed after the construction of the building is completed.

Figure 9:
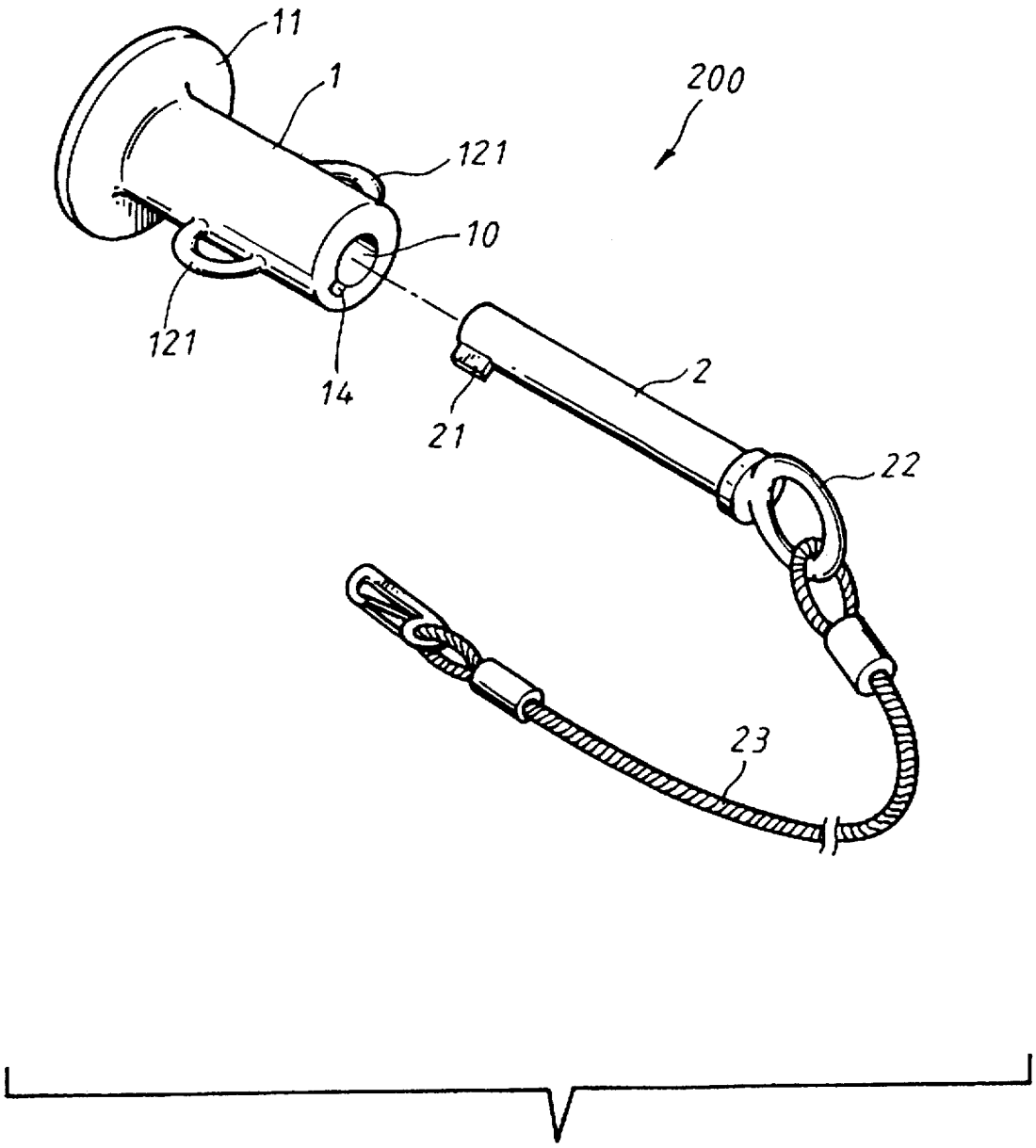
FIG. 9 is a view similar to FIG. 1, but showing showing a safety anchor made in accordance with a second embodiment of the present invention in a detached condition.

In FIG. 9, a second embodiment of the present invention, generally designated with reference numeral 200, is shown. In the safety anchor 200, the rod-like side wings 12 illustrated in FIG. 1 are replaced by rings 121. The rings 121 serve as hangers for hanging articles thereon. This is particularly advantageous when the safety anchor 200 is used in the application of steel structure frame for the rings 121 are allowed to expose, rather than buried in the concrete of a reinforced concrete frame.

Although preferred embodiments-of the present invention have been described to illustrate the present invention, it is apparent that changes and modifications in the preferred embodiments can be carried out without departing from the scope of the invention which is intended to be limited only by the appended claims.

What is claimed is:

1. A safety anchor system comprising:

a fixed member being at least partially embedded in a concrete portion of a building structure and having an expanded base portion secured to a reinforcing member of the concrete portion, said fixed member having a cylindrically shaped body extending longitudinally from said base portion, said cylindrically shaped body having (a) a bore extending longitudinally from an end thereof opposite said base portion to form an opening in said fixed member, (b) a longitudinally extended slot formed in an inner surface of a wall circumscribing said bore and extending to a distal end thereof, (c) a circumferential slot formed in said inner surface of said wall adjacent said distal end of said bore, said circumferential slot having a first end in open communication with said longitudinally extended slot, (d) a retaining slot formed in said inner surface of said wall in open communication with a second end of said circumferential slot and extending longitudinally therefrom, and (e) a pair of rod shaped projections longitudinally spaced from said expanded base and extending radially from on an outer surface of said wall for securement to respective reinforcing members of the concrete portion of the building structure;

a removable member having a longitudinally extended body releasably engageable to said fixed member within said bore, said removable member body having a key formed thereon adjacent a first end thereof, said key being dimensioned for slidable engagement with said longitudinally extended slot and displacement through said circumferential slot into said retaining slot, said removable member having means for securing a load thereto formed to a second end of said longitudinally extended body; and, a spring disposed within said bore for applying a bias force to said removable member to reversibly capture said key within said retaining slot.

* * * * *